US010113122B2

(12) United States Patent
Zheng et al.

(10) Patent No.: US 10,113,122 B2
(45) Date of Patent: Oct. 30, 2018

(54) PROCESS FOR UPGRADING HEAVY HYDROCARBON LIQUIDS

(71) Applicant: UNIVERSITY OF NEW BRUNSWICK, Fredericton (CA)

(72) Inventors: Ying Zheng, New Maryland (CA); Qikai Zhang, New Maryland (CA); Hongfei Lin, Nanning (CN)

(73) Assignee: UNIVERSITY OF NEW BRUNSWICK, Fredericton, NB (CA)

( * ) Notice: Subject to any disclaimer, the term of this patent is extended or adjusted under 35 U.S.C. 154(b) by 0 days.

(21) Appl. No.: 15/253,297

(22) Filed: Aug. 31, 2016

(65) Prior Publication Data

US 2017/0058211 A1 Mar. 2, 2017

Related U.S. Application Data

(60) Provisional application No. 62/212,165, filed on Aug. 31, 2015.

(51) Int. Cl.

| | |
|---|---|
| ***C10G 47/32*** | (2006.01) |
| ***C10G 49/18*** | (2006.01) |
| ***C10G 65/12*** | (2006.01) |

(52) U.S. Cl.

CPC ..... *C10G 65/12* (2013.01); *C10G 2300/42* (2013.01); *C10G 2300/80* (2013.01)

(58) Field of Classification Search

None

See application file for complete search history.

(56) References Cited

U.S. PATENT DOCUMENTS 4,567,156 A * 1/1986 Bearden, Jr. ..... B01J 23/26 208/108

6,156,946 A 12/2000 Coyle (Continued)

FOREIGN PATENT DOCUMENTS

CA 2737872 A1 5/2012
CA 2809503 A1 6/2013

(Continued)

OTHER PUBLICATIONS

Pant et al., Renewable hydrogen production by steam reforming of glycerol over Ni/CeO2 catalyst prepared by precipitation deposition method, Korean J. Chem. Eng., 28(9), 1859-1866 (2011).*

(Continued)

*Primary Examiner* — Philip Y Louie

(74) *Attorney, Agent, or Firm* — Lynn C. Schumacher; Stephen W. Leonard; Hill & Schumacher

(57) ABSTRACT

The present disclosure provides a process that employs glycerol and a catalyst for partial transformation of heavy petroleum oils to lighter hydrocarbon liquids under mild conditions without the need of external hydrogen gas. The process uses industrially produced glycerol to upgrade heavy crudes; hydrogenates aromatics to paraffin and/or olefins without the use of external hydrogen gas; operates at mild operating conditions; and employs inexpensive catalysts. This process is completely different from the hydroconversion process where high pressurized hydrogen gas is essential. The present process requires no pressurized hydrogen gas and can significantly reduce both operating and capital costs of the traditional hydrotreating process.

14 Claims, 1 Drawing Sheet

(56) References Cited

U.S. PATENT DOCUMENTS

| | | | | |
|---|---|---|---|---|
| 6,485,631 | B1 | 11/2002 | Ellingsen | |
| 8,420,565 | B2 | 4/2013 | Mironov et al. | |
| 8,809,605 | B2 | 8/2014 | Bao et al. | |
| 2007/0231870 | A1 | 10/2007 | Leon | |
| 2007/0267372 | A1 | 11/2007 | Boakye | |
| 2007/0295644 | A1 | 12/2007 | Chirinos | |
| 2008/0099374 | A1 | 5/2008 | He | |
| 2008/0099376 | A1 | 5/2008 | He | |
| 2008/0099377 | A1 | 5/2008 | He | |
| 2008/0099378 | A1 | 5/2008 | He | |
| 2008/0299019 | A1 | 12/2008 | Dighe | |
| 2009/0159498 | A1* | 6/2009 | Chinn | C10G 9/00 208/85 |
| 2009/0166261 | A1 | 7/2009 | Li | |
| 2009/0223118 | A1 | 9/2009 | Everton et al. | |
| 2010/0176025 | A1 | 7/2010 | Kumar | |
| 2010/0228068 | A1* | 9/2010 | O'Connor | C10G 3/46 585/733 |
| 2010/0326880 | A1 | 12/2010 | Chakka | |
| 2011/0120908 | A1 | 5/2011 | Marzin | |
| 2011/0124496 | A1 | 5/2011 | Mironov | |
| 2011/0174690 | A1 | 7/2011 | Canelon | |
| 2011/0210045 | A1 | 9/2011 | Kou | |
| 2012/0000830 | A1 | 1/2012 | Monaghan | |
| 2012/0181216 | A1 | 7/2012 | Kozyuk | |
| 2012/0270957 | A1 | 10/2012 | Kresnyak | |
| 2012/0289440 | A1 | 11/2012 | Pollard | |
| 2013/0277273 | A1 | 10/2013 | Mazyar | |
| 2013/0299387 | A1 | 11/2013 | Salazar | |
| 2013/0334100 | A1 | 12/2013 | Mazyar | |
| 2014/0014558 | A1 | 1/2014 | Gordon | |
| 2014/0109465 | A1 | 4/2014 | Coppola | |
| 2014/0163249 | A1 | 6/2014 | Chen et al. | |
| 2014/0221709 | A1 | 8/2014 | Baldassari | |
| 2014/0262937 | A1 | 9/2014 | Kresnyak | |
| 2014/0287469 | A1 | 9/2014 | Medoff | |
| 2014/0314628 | A1 | 10/2014 | Agolli | |
| 2014/0325896 | A1 | 11/2014 | Haan | |
| 2014/0343333 | A1 | 11/2014 | Ginestra | |

FOREIGN PATENT DOCUMENTS

| | | | |
|---|---|---|---|
| CA | 2822455 | A1 | 11/2013 |
| CA | 2810898 | A1 | 9/2014 |
| CN | 203484148 | U | 3/2014 |
| FR | 1136576 | A | 5/1957 |
| WO | 2008/124912 | A1 | 10/2008 |
| WO | 2009/103088 | A1 | 8/2009 |
| WO | 2014/172361 | A1 | 10/2014 |
| WO | 2015/023842 | A2 | 2/2015 |

OTHER PUBLICATIONS

Mark J. Kaiser and James H. Gary, "Study Updates Refinery Investment Cost Curves", published: Apr. 23, 2007.

William M. Hunter, "Report of the Alberta Royalty Review Panel", Our Fair Share, Sep. 18, 2007, 104 pages, Alberta Department of Energy, Alberta, Canada.

* cited by examiner

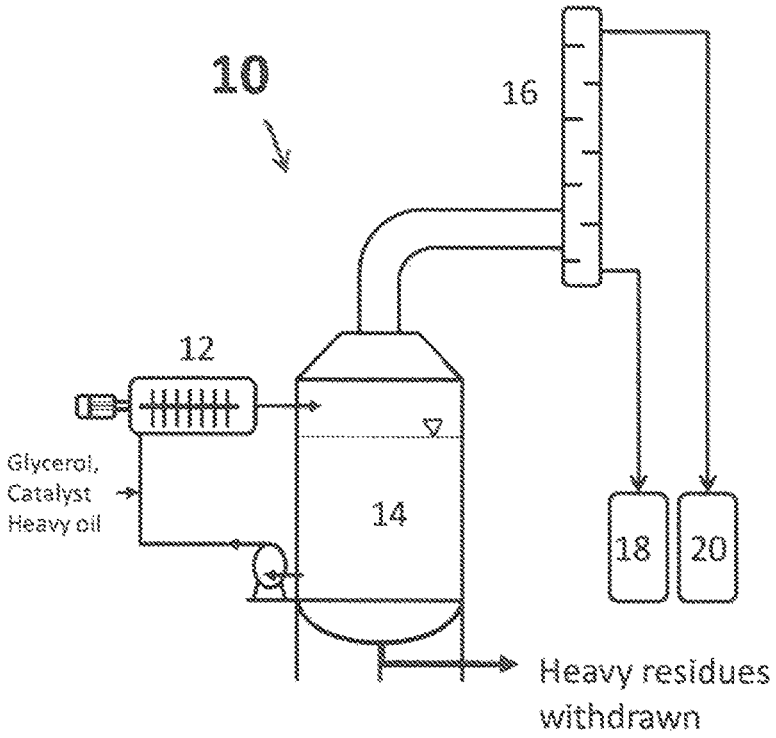
10
16
12
Glycerol,
Catalyst
Heavy oil
14
18
20
Heavy residues
withdrawn

PROCESS FOR UPGRADING HEAVY HYDROCARBON LIQUIDS

FIELD

The present disclosure relates to a process for upgrading heavy hydrocarbon liquids.

BACKGROUND

Tighter fuel specifications coupled with more stringent environmental regulations have compressed refinery margins. There is a growing drive to cost-effectively maximize production of more valuable, lighter fuel products from heavy portions of every barrel of crude oil processed.

Crude oils are complex mixtures of hundreds of different species of chemical compounds. Higher value crude oils are typically referred to as lighter "sweet" crude oils while heavier crude oils are known as "sour", as they contain high concentrations of sulphur (S), nitrogen (N) and oxygen (O) together with metal impurities such as vanadium (V) and nickel (Ni). The oil processing industry has an inevitably finite feedstock. Light feedstocks are steadily being replaced by the heavier crude oils or even alternative types of feeds altogether (such as bitumen derived from oil sands). Not only does the processing of these heavier feedstocks usually result in lower yields of the desired lighter products, but the higher concentrations of the various contaminants makes this processing more difficult and hence more expensive.

The specific gravity of crude oil and petroleum products is generally expressed in degrees API (American Petroleum Institute). API gravity is an inverse measure of a petroleum liquid's density relative to that of water (also known as specific gravity). An API of 10° is equivalent to water. It means that a petroleum liquid with an API greater than 10° will float on water while any with an API below 10° will sink. While API gravity is a dimensionless quantity, it is referred to as being in 'degrees'. API gravity is gradated in degrees on a hydrometer instrument. If one petroleum liquid is less dense than another, it has a greater API gravity. API gravity values of most petroleum liquids fall between 10 and 70 degrees.

Therefore, heavy crude oils, having an API gravity of less than 20°, suggest high viscosity, a high content of polynuclear compounds and relatively low hydrogen content. Extensive Reserves of heavy crudes are found in a number of countries, including Western Canada, Venezuela, Russia, the US and elsewhere. Heavy crudes also include distillation residues, visbreaker tars, thermal tars, etc.

Crude oils need to be processed and refined into more useful products such as: gasoline, diesel, kerosene, etc. Most refineries, regardless of complexity, perform a few basic steps in the refining process, including but not limited to: distillation, cracking, treating and reforming. Distillation separates the hydrocarbons against boiling points. An atmospheric distillation unit separates the lighter hydrocarbons from the heavier oils based on boiling point. To increase the production of high-value petroleum products, these heavier oils left in the bottom of the distillation unit are run through a vacuum distillation column to further refine them.

The product that is left at the bottom of a vacuum distillation unit is referred to as a vacuum bottom, which is the heaviest material in the refinery tower. Fluid catalytic cracking (FCC) is primarily used in producing additional gasoline in the refining process. It is a chemical process that uses a catalyst to convert the high-boiling, high-molecular weight hydrocarbon fractions of petroleum crude oils to more valuable gasoline. Heavy cycled gas oil is the bottom product of FCC and is referred to as slurry oil that contains catalysts not captured by cyclones in the FCC unit.

Similar to heavy crudes, both slurry oils and vacuum bottoms are also considered as heavy fuels. Two primary routes exist for the conversion of such feeds, both serving to reduce the C:H ratio, hence resulting in a decline in the viscosity, boiling point and solid formation tendencies of the feed. These routes involve either reducing the amount of carbon or increasing the hydrogen, termed "carbon rejection" and "hydroconversion" respectively.

The carbon rejection process (also referred to as the coking process) is operated at elevated temperature and pressure; see Table 1 below for processing details which can vary significantly depending on the process being used. These processes include visbreaking, fluid coking or delayed coking, and flexicoking, which relies solely on thermally initiated radical reactions to both crack larger, higher boiling molecules into lighter species and to condense carbon-rich radical fragments into coke. The removal of carbon as coke results in an overall reduction in the C:H ratio for the liquid species, manifesting itself as a decline in the viscosity and average boiling point temperature. The low value coke by-product, which may be present in up to 20 wt % of the final product, is heavily contaminated and represents a significant environmental hazard. In addition, carbon rejection processes frequently produce incompatible two-phase products and de-asphalting results in a low yield of syncrudes.

TABLE 1

| Process | Process conditions |
|---|---|
| Visbreaking | Mild thermal cracking (low severity)<br>Mild (470-500° C.) heating at 50-200 psig<br>Improve the viscosity of fuel oil |
| Delayed Coking | Operates in semi-batch mode<br>Moderate (480-515° C.) heating at 90 psig, Soak drums (450-480° C.° F.) |
| Fluid Coking | Server (510-520° C.) heating at 10 psig<br>Oil contact refractory coke Bed fluidized with steam-even heating,<br>Higher yield of light ends ($<C_5$), Less coke yield |
| Flexicoking | A continuous fluidised bed technology which converts heavy residue to lighter more valuable product. The process essentially eliminates the coke production. Temperature 510-540° C. |

Hydroconversion operating conditions vary greatly, with temperatures ranging from 370 to 450° C. and pressures from 0.7 to 2.7 MPa, depending on the reactor type (typically fixed bed, fluidised bed or slurry-phase), catalyst type and feed. This process is often conducted in the presence of either a supported metal catalyst, such as $NiMo/Al_2O_3$, or an unsupported metal catalyst, such as Fe or Mo for example. Similar to the carbon rejection process, cracking within a hydroconversion reactor occurs by radical reactions initiated by the elevated temperatures, with coke being formed by condensation reactions between radicals. The catalyst can activate hydrogen dissolved in the residue oil to form free hydrogen radicals which then stabilise hydrocarbon radicals and hydrogenate the molecules, resulting in an overall decrease in the C:H ratio. Hydroconversions normally generate high quality products but require high pressure of hydrogen gas and frequent regeneration of catalysts, leading to a high cost.

SUMMARY

Broadly, the present disclosure provides a process that employs glycerol and a catalyst for partial transformation of heavy petroleum oils to lighter hydrocarbon liquids under mild conditions without the need of external hydrogen gas. The process uses industrially produced glycerol to upgrade heavy crudes; hydrogenates aromatics to paraffin and/or olefins without the use of external hydrogen gas; operates at mild operating conditions; and employs inexpensive catalysts. This process is completely different from the hydroconversion process where high pressurized hydrogen gas is essential. The present process requires no pressurized hydrogen gas and can significantly reduce both operating and capital costs of the traditional hydrotreating process.

An embodiment disclosed herein provides a process for upgrading heavy hydrocarbon liquids, comprising:

a) mixing a pre-heated heavy hydrocarbon liquid feedstock with glycerol and a catalyst to form a mixture, wherein the mixture has a heavy hydrocarbon liquid feedstock to glycerol weight ratio from about 5000:1 to about 100:10 and a heavy hydrocarbon liquid feedstock to catalyst weight ratio from about 5000:1 to about 100:10;

b) feeding the mixture into a first reactor comprising propellers, heated up to a temperature in a range from about 200° C. to about 450° C. to partially treat the mixture, maintaining a pressure in the first reactor in a range from about +0.5 MPa to about −0.1 MPa (equivalent to absolute pressure of about 0.6 MPa to about 0 MPa), and driving said propellers to apply shear forces to the mixture in a range from about 300 $N/m^2$ to about 10000 $N/m^2$;

c) after a preselected period of time, flowing the partially treated mixture to a second reactor having a holding volume larger than the first reactor, heated up to a temperature in a range from about 250° C. to about 380° C. and maintaining a pressure in the second reactor in a range from about +0.5 MPa to about −0.1 MPa (equivalent to absolute pressure of about 0.6 MPa to about 0 MPa) to further treat the partially treated mixture, said second reactor having a bottom with a bottom exit port and top exit port such that first hydrocarbon fractions are separated from second hydrocarbon fractions, wherein the first hydrocarbon fractions have a boiling point higher the second hydrocarbon fractions, and the second hydrocarbon fractions are vaporized and flow up through the top exit and collected into a distillation column, and said first hydrocarbon fractions sink to the bottom of the second reactor and are flowed out through the bottom exit port and recirculated back to the first reactor; and d) collecting an upper portion of the second hydrocarbon fractions separated from a lower portion of the second hydrocarbon fractions in the distillation column out through an upper exit port and storing the collected upper portion of the second hydrocarbon fractions, and collecting the lower portion of the second hydrocarbon fractions out through a lower exit port and storing the collected lower portion of the second hydrocarbon fractions, wherein the upper portion of the second hydrocarbon fractions has a boiling point lower than the lower portion of the second hydrocarbon fractions In an embodiment, the mixing of the pre-heated heavy hydrocarbon liquid feedstock with glycerol is done in a range of weight ratios from about 1000:1 (feed to glycerol) to about 100:2.

In an embodiment, the mixing of the pre-heated heavy hydrocarbon liquid feedstock with glycerol and catalyst is done in a range of weight ratios from about 1000:1 to about 100:5 (feed to glycerol).

In an embodiment, the temperature of the first reactor is maintained at a temperature in a range from about 280° C. to about 380° C.

In an embodiment, the pressure in the first reactor is maintained in a range from about +0.1 MPa to about −0.1 MPa (equivalent to absolute pressure of about 0.2 MPa to about 0 Mpa).

In an embodiment, the pressure in the second reactor is maintained in a range from about +0.1 MPa to about −0.1 MPa (equivalent to absolute pressure of about 0.2 MPa to about 0 Mpa).

In an embodiment, the reactor propellers may be driven to apply shear forces to the mixture in a range from about 2000 $N/m^2$ to about 10000 $N/m^2$.

The catalyst is any one or combination of metal oxides containing metals from Groups 4, 6, 8, 12 and 13 of the Periodic Table, alkaline earth metal oxides, transition metals supported on a catalyst support, transition metal doped catalysts. The metal oxides containing metals from Groups 4, 6, 8, 12 and 13 of the Periodic Table may include any one or combination of $TiO_2$, $ZrO_2$, $Al_2O_3$, ZnO, $Cr_2O_3$, $WO_3$, $Fe_2O_3$, $Fe_3O_4$ and $MoO_3$. The alkaline earth metal oxides may include any one or combination of CaO, MgO, and BaO. The transition metal doped catalysts include the alkaline earths doped with any one or combination of transition metals belonging to Groups VIIB, VIII, IB of the Periodic Table. The transition metals belonging to Groups VIIB, VIII, IB of the Periodic Table may comprise any one or combination of Mn, Re, Fe, Co, Ni, Ru, Pd, Pt, Cu and Pb. The catalyst support may comprise any one or combination of $SiO_2$, aluminum silicates, clays, zeolites and hydroxylapatite.

A further understanding of the functional and advantageous aspects of the disclosure can be realized by reference to the following detailed descriptions and drawings.

BRIEF DESCRIPTION OF THE DRAWINGS

The present disclosure will be more fully understood from the following detailed descriptions thereof taken in connection with the accompanying drawings, which form a part of this application, and in which:

FIGURE is a diagrammatic representation of an exemplary reactor system that may be used for upgrading heavy hydrocarbon liquids according to the process disclosed herein.

DETAILED DESCRIPTION

Various embodiments and aspects of the disclosure will be described with reference to details discussed below. The following description and drawings are illustrative of the disclosure and are not to be construed as limiting the disclosure. The drawings are not necessarily to scale. Numerous specific details are described to provide a thorough understanding of various embodiments of the present disclosure. However, in certain instances, well-known or conventional details are not described in order to provide a concise discussion of embodiments of the present disclosure.

As used herein, the terms, "comprises" and "comprising" are to be construed as being inclusive and open ended, and not exclusive. Specifically, when used in this specification including claims, the terms, "comprises" and "comprising" and variations thereof mean the specified features, steps or components are included. These terms are not to be interpreted to exclude the presence of other features, steps or components.

As used herein, the term "exemplary" means "serving as an example, instance, or illustration," and should not be construed as preferred or advantageous over other configurations disclosed herein.

As used herein, the terms "about" and "approximately", when used in conjunction with ranges of dimensions of particles, compositions of mixtures or other physical properties or characteristics, are meant to cover slight variations that may exist in the upper and lower limits of the ranges of dimensions so as to not exclude embodiments where on average most of the dimensions are satisfied but where statistically dimensions may exist outside this region. It is not the intention to exclude embodiments such as these from the present disclosure.

As used herein, glycerol (also called glycerine or glycerin) is a simple polyol (sugar alcohol) compound (molecule). It is an odorless, colorless and viscous liquid that is widely used in pharmaceutical formulations. Glycerol has three hydroxyl groups that are responsible for its solubility in water and its hygroscopic nature. The glycerol backbone is central to all lipids known as triglycerides. Glycerol is sweet-tasting and is non-toxic. Its formula is:

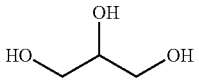

Glycerol, which as can be seen from the formula above is a trihydric containing three hydroxyl groups, and is a chemical byproduct of biodiesel production. Every gallon of biodiesel produced generates approximately 1.05 pounds of glycerol. It is projected that the world biodiesel market will reach a production rate of 37 billion gallons by 2016, which implies that approximately 4 billion gallons of crude glycerol will be produced and available. Too much surplus of crude glycerol generated from biodiesel production will have a negative impact on the refined glycerol market. For example, in 2007, refined glycerol's price was painfully low, approximately $0.30 per pound (compared to $0.70 before the expansion of biodiesel production) in the United States. Accordingly, the price of crude glycerol decreased from about $0.25 per pound to $0.05 per pound. Therefore, development of sustainable processes for utilizing this organic raw material would be very advantageous for the refined glycerol industry.

In the process disclosed herein, heavy hydrocarbon liquids and crude glycerol are the reactants, where glycerol is an additive to facilitate the chemical transformation of large molecules of the heavy hydrocarbon constituents into smaller molecules in the presence of a catalyst.

As used herein, the phrase "heavy hydrocarbon liquids", refer to the materials or feedstocks which are the hydrocarbon materials which can be upgraded by the process disclosed herein. Crude oil needs to be processed and refined into more useful products such as: gasoline, diesel, kerosene, etc. Most refineries, regardless of complexity, perform a few basic steps in the refining process: distillation, cracking, treating and reforming. Distillation separates the hydrocarbons against boiling points. An atmospheric distillation unit separates the lighter hydrocarbons from the heavier oils based on boiling point and the resulting heavier hydrocarbon fraction is referred to as the "atmospheric petroleum residue". To increase the production of high-value petroleum products, the heavier fractions, or bottoms, are run through a vacuum distillation column to further refine them. The left over bottom product of a vacuum distillation unit, called vacuum bottoms, or "vacuum petroleum residues", are the heaviest hydrocarbon liquid or material in the refinery tower. Fluid catalytic cracking (FCC) is primarily used in producing additional gasoline in the refining process. It is a chemical process that uses a catalyst to convert the high-boiling, high-molecular weight hydrocarbon fractions of petroleum crude oils to more valuable gasoline. Heavy cycled gas oil is the bottom product of FCC and is referred to as slurry oil that contains catalysts not captured by cyclones in the FCC unit.

Similar to heavy crudes, both slurry oils and vacuum bottoms are also considered heavy fuels. Two primary routes exist for the conversion of such feeds, both serving to reduce the C:H ratio, hence resulting in a decline in the viscosity, boiling point and solid formation tendencies of the feed. These routes involve either reducing the amount of carbon or increasing the hydrogen, termed "carbon rejection" and "hydroconversion" respectively.

The carbon rejection or coking process is operated at elevated temperature and pressure. The processes include visbreaking, fluid coking or delayed coking, which relies solely on thermally initiated radical reactions to both crack larger, higher boiling molecules into lighter species and to condense carbon-rich radical fragments into coke. The removal of carbon as coke results in an overall reduction in the C:H ratio for the liquid species, manifesting as a decline in the viscosity and average boiling point temperature. The low value coke by-product, which may present up to 20 wt % of the final product, is heavily contaminated and represents a significant environmental hazard. In addition, carbon rejection processes frequently produce incompatible two phase products and deasphalting results in low yield of syncrudes.

The present disclosure provides a new approach for improving quality of heavy oils at mild operating conditions without the need of hydrogen gas. The new process uses glycerol and catalysts to convert large molecules into smaller ones and to lower viscosity of heavy crudes. Glycerol is a byproduct of biodiesel production. As biodiesel production increases, the price of glycerol drops significantly. This inexpensive chemical is used, in this disclosure, to upgrade heavy oils over a catalyst. The unique structure of glycerol makes it possible to perform catalytic decomposition to release in-situ hydrogen which is far more active than hydrogen gas (as shown below). Meanwhile, decomposition of glycerol releases CO, $CO_2$ and $H_2O$. A water-gas shift reaction also takes place and more in-situ hydrogen is produced. The in-situ hydrogen can facilitate C—C scission, saturate C=C and remove containments such as sulfur and nitrogen. Heavy fuels are then partially upgraded.

The present disclosure discloses a new approach for improving the quality of heavy oils under mild operating conditions. The new process uses industrial glycerol (a byproduct of biodiesel production) and transition metal catalysts to partially upgrade heavy hydrocarbons to lighter and more valuable hydrocarbon products. The advantages of the disclosed process are mild operating conditions, a hydrogen free process and simplified process control thereby providing a very economically advantageous upgrading method of existing upgrading processes.

Broadly speaking, the process includes mixing a preheated heavy hydrocarbon liquid feedstock with glycerol in a range of weight ratios from about 5000:1 (feed to glycerol)

to about 100:10, and more preferably from about 1000:1 to about 100:2, to form a mixture, and with a catalyst in a range of weight ratios from about 5000:1 (feed to catalyst) to about 100:10, and more preferably from about 1000:1 to about 100:5, to form a mixture.

A reactor system that may be used for the present upgrading process is shown generally at 10 in the Figure. Reactor 12 and reactor 14 are designed according to Chinese patent CN203484148U. In reactor 12, gas (by-products), liquid (reactants) and solid (catalysts) are well mixed. In some embodiments the propellers of reactor 12 are designed to provide large shear forces, in ranges from about 300 $N/m^2$ (Newtons/$meter^2$) to about 10000 $N/m^2$, to liquid reactants so as to promote the reactions. Both glycerol and catalysts are mixed with hydrocarbon liquid before being introduced into reactor 12. In some embodiments the propellers may be driven to apply shear forces to the mixture in a range from about 2000 $N/m^2$ to about 10000 $N/m^2$.

This mixture is fed into reactor 12 which has been heated up to a temperature in a broad range from about 200° C. to about 450° C., and more preferably in a range from about 280° C. to about 380° C. In some embodiments the pressure in the first reactor may be maintained in a range from about +0.5 MPa to about −0.1 MPa. In some processes the pressure in the first reactor may be maintained in a range from about +0.1 MPa to about −0.1 MPa.

The pressure of the first reactor 12 is due in part to the cracking reactions that take place in the reactor 12. With the presence of glycerol at the reaction temperatures, large molecules of hydrocarbons have a high probability of being cracked into smaller hydrocarbons over the catalysts. These resulting smaller hydrocarbons are present as a vapor in the reactor 12. Thus positive pressures are produced in the reactor 12. To quickly remove these smaller hydrocarbons, negative pressures may be maintained inside the reactor 12. A vacuum pump (not shown) may be used to maintain negative pressures.

In an embodiment, up to 10 wt % glycerol (depending on the quality of the heavy oils) is used and heavy liquid hydrocarbons below 450° C. for partial upgrading of heavy oils in the presence of a catalyst. The three phases are mixed so well that gas phase is in the form of very small gas bubbles mixed with liquid reactant and solid catalyst is also uniformly distributed in the liquid reactant. Reactor 12 is a smaller reactor where the main reactions take place. Reactor 14 functions as a separator. Reactor 14 is larger than reactor 12, at least twice as large in volume. When products are flashed in to reactor 14 from reactor 12, lighter fractions are quickly vaporized while heavier fractions remain in liquid form. The lighter and heavier fractions are separated in reactor 14. Since reactor 14 is much larger than reactor 12, the release of products from reactor 12 will not cause severe pressure fluctuations of the whole system.

The treated products in reactor 12 are released to reactor 14 where light fractions and heavy fractions are quickly separated. Another function of reactor 14 is to maintain steady pressure of the whole system. Since reactor 14 is much larger than reactor 12, the pressure of the whole system will not fluctuate when products are released to reactor 14. Additional reactors 12 can be placed around reactor 14 and the products are released to reactor 14 when large amount of heavy oil is required to be upgraded, on an industrial commercial scale.

Preheated heavy oil mixed with catalyst (up to 10 wt %) and glycerol (up to 10 wt %) is introduced to reactor 12, where reactions take place. The temperature of reactor 12 is maintained up to 450° C. Within the reactor, gas, liquid and solid (catalyst) are mixed well, such that resistances of mass and heat transfer between the three phases are negligible. The residence time of heavy oil in reactor 12 is less than 10 minutes typically. However, the residence time for the mixture in reactor 12 may have a wide range, from about 1 minute to about 100 minutes, preferably 2 minutes to 30 minutes, but as noted above, 10 minutes is usually sufficient. The treated heavy oil is then released to reactor 14 where the heavy fractions of the oil are separated from the lighter fractions. Reactor 14 is generally maintained at a temperature similar to the temperature of reactor 12. Alternatively, the temperature of reactor 14 may be set to meet the boiling points of the preferable hydrocarbon product so that the preferable hydrocarbons can be vaporized and collected at column 16. The pressure of reactor 14 is preferably operated at the same pressure of reactor or a pressure lower than reactor 12, so that small hydrocarbons are easy to vaporize when hydrocarbon liquids enter reactor 14. Thus the pressure in reactor 14 may be in a range from about +0.5 MPa to about −0.1 MPa, and more narrowly in the range from +0.1 MPa to about −0.1 MPa.

The light fractions are vaporized to a distillation column 16 where water and light hydrocarbons are collected at the top and relative heavier fractions are collected at the bottom of distillation column 16. Side withdrawals from distillation column 16 can be added when it is needed. This process may be operated as a continuous operation such that fresh feedstocks are continuously added to reactor 12 and lighter fractions are vaporized in reactor 14. Further separation of the lighter fractions takes place in distillation column 16.

Distillation column 16 may be either a trayed column or a packed column and is operated under conditions known to those skilled in the art. It receives the vaporized hydrocarbons released from reactor 14. In the distillation column 16, lighter hydrocarbons are separated from heavier hydrocarbons. Lighter hydrocarbons are collected from the top of unit 16 and stored in tank 20 while heavier hydrocarbons are collected from the bottom of unit 16 and stored in tank 18. The bottom heavier fractions from reactor 14 are recycled back to reactor 12 after being mixed with fresh heavy fuels, catalyst and glycerol. Periodically, the residue or bottoms of reactor 14 may be partially withdrawn and sent to cokers.

The temperature of the reaction in reactor 12 can range from about 200° C. to about 450° C. and in a more preferred range between 280° C. and 380° C. The pressure of the reaction can range from vacuum, −0.1 MPa, up to about 0.5 MPa. Light hydrocarbons, CO, $CO_2$, $H_2O$ produced during the reaction produce the pressure in the reactor. External hydrogen gas is not used in this reactor. Vacuum atmosphere may be created by using a vacuum pump to extract out the reactants from reactor 12.

As noted above, glycerol has three hydroxyl groups such that it is a highly functionalized molecule compared to hydrocarbons. The unique structure of glycerol makes it amenable to catalytic decomposition to thereby release in-situ hydrogen. Over a proper catalyst, glycerol is catalytically decomposed to in-situ hydrogen, CO, $CO_2$, $H_2O$ and other oxygenates and small hydrocarbons such as ethylene. The in-situ hydrogen is far more active than hydrogen gas. A water-gas shift reaction ($CO+H_2O \leftrightarrow H_2+CO_2$) also takes place with the result that more in-situ hydrogen is produced. The in-situ hydrogen can facilitate C—C scission and saturate C=C. In addition, radicals such hydroxyl radicals and alkyl radicals are also typically produced. Free radicals can improve the process of C—C scission. Thus, long hydrocarbon chains of heavy oil become shorter; paraffin contents in light fractions (collected in storage 20)

increase; multiple-ring aromatics are partially transformed into single- or double-ring aromatics; nitrogen and sulfur contents are also reduced.

The catalysts may be a) transition metals located on catalyst supports, b) metal oxides, and c) alkaline earth metal oxides or mixtures thereof, and may be doped with transition metals to give transition metal doped catalysts. The metal oxides are at least one or combination of $TiO_2$, $Al_2O_3$, ZnO, $ZrO_2$, $WO_3$, $Fe_2O_3$, $Fe_3O_4$ or $MoO_3$. The alkaline earth metal oxides include MgO, CaO, BaO. The transition metals may be supported on materials such as aluminum silicates, clays, zeolites, and Hydroxylapatite. The transition metal may belong to groups VIIB, VIII, IB, such as Mn, Re, Fe, Co, Ni, Ru, Pd, Pt, Cu for example.

The products include non-condensable gases, hydrocarbon liquid products, and heavy residues consisting of catalysts. The non-condensable gaseous products are mainly composed of CO, $CO_2$, light hydrocarbons <C5. The gaseous product is a by-product and can be treated as a flue gas. Hydrocarbon liquid products are the vaporized hydrocarbons entering unit 16, where they are further separated into heavier products which are stored in tank 18 and lighter products stored in tank 20. The heavy residue is present in liquid form which settles down at the bottom of reactor 14 and it may be continuously pumped from reactor 14 and mixed with fresh feedstock and then sent back to reactor 12. Periodically, the heavy residues that settle to the bottom of the reactor 14 may be partially collected and sent to a coker or blended with asphalt or other heavy residues that might be produced by other refinery processes.

EXAMPLE 1

Slurry Oil from Fluid Catalytic Cracking Unit (FCCU)

300 grams of heavy slurry oil (#2) was preheated to 160° C. and then introduced to reactor 12 along with 15 grams glycerol and 1 gram catalyst (equal fraction of $Al_2O_3$, $Fe_2O_3$ and CaO). The reactor was maintained at 380° C. The stir within the reactor rotates between 500-1500 rpm, vigorously mixing glycerol, catalyst and slurry oil. Reactor 12 and reactor 14 are maintained at a pressure slightly lower than atmospheric pressure so that light fractions produced during the reaction can be continuously separated. The liquid products were analyzed using the SARA heavy oil analysis method and the ASTM protocol (ASTM-D2887). The results are shown in Tables 2 and 3. "Slurry Oil" is the feed and "Hydrocarbon products" refers to the mixture of liquid hydrocarbons stored in tanks 18 and 20. Through the technology, the viscosity of liquid products has been dropped down to 46 mPa·s from 187 mPa·s of the feed. The sulfur contents are reduced by 14%. Resins are reduced by 4% and aromatics went down by 6%. On the other hand, saturates increased 8% from 32% to 40%. The boiling point distributions of feed and hydrocarbon products were determined by the Simulated Distillation Analysis. The initial boiling point is reduced from 350° C. of the feed to 154° C. of the liquid product. The diesel fraction in the hydrocarbon products increased up to 20 wt %. The median boiling points drop from 460° C. to 439° C. after the feed is processed using the disclosed technology. The fractions of heavy residues, which boiling points are higher than 500° C., are reduced from 30 wt % down to 23 wt %. The hydrocarbon products appear to have better quality than the feed.

TABLE 2

| | Slurry oil | Hydrocarbon products |
|---|---|---|
| Viscosity, mPa · s (40° C.) | 187 | 46 |
| Asphaltene | 7% | 5% |
| Saturates | 32% | 40% |
| Aromatics | 47% | 41% |
| Resins | 13% | 9% |
| S (ppm, mass) | 5678 | 4900 |
| Total | 99% | 96% |

TABLE 3

| ASTM-D2887 Boiling point | Slurry oil wt % collected | Hydrocarbon products wt % collected |
|---|---|---|
| 154° C. | 0 | 1 |
| 350° C. | 2 | 20 |
| 439° C. | — | 50 |
| 460° C. | 50 | — |
| 500° C.+ | 30 | 23 |

EXAMPLE 2

Vacuum Bottom

Experimental procedures and analysis methods for the vacuum bottom are the same as what is described above. 300 grams of vacuum bottom is used to replace slurry oil. 0.5 gram Ni/Kaoline and 0.5 gram $MoO_3$ are used as the catalyst. The results are listed in the Table 4 below. Vacuum bottom is the feedstock while "Hydrocarbon products" refers to the mixture of liquid hydrocarbons stored in storage in tanks 18 and 20. Sulfur contents were reduced by 40%. Saturates increased by 5% where resins were reduced by 4%.

TABLE 4

| | Vacuum bottom | Hydrocarbon products |
|---|---|---|
| Saturates | 52% | 57% |
| Aromatics | 27% | 26% |
| Resins | 18% | 14% |
| S (ppm, mass) | 2419 | 1435 |
| Total | 97% | 97% |

EXAMPLE 3

300 kg/hour of heavy slurry oil (#2) was preheated to 350° C. and continuously introduced to reactor 12 along with 1.5 kg glycerol and 1.5 kg catalyst (equal fraction of $TiO_2$, $Fe_2O_3$, CaO and zeolite). The residence time of heavy slurry oil in reactor 12 was less than 10 minutes. The reactors 12 and 14 were maintained at 350° C. The stir within the reactor rotates 1000 rpm, vigorously mixing glycerol, catalyst and slurry oil. Reactor 12 and reactor 14 are maintained at a pressure slightly lower than atmospheric pressure so that light fractions produced during the reaction can be continuously separated. Light fractions (boiling points less than 280° C.) were collected in storage 20 while relatively heavy fractions boiling points between 280° C. and 360° C. were collected in storage 18. Heavier fractions sink to the bottom of reactor 14 are recirculated back to reactor 12. Periodically, the residue or bottoms of reactor 14 are partially withdrawn. The analysis methods for the original slurry and products are the same as what is described above. The saturates are significantly increased in hydrocarbon products (mixture of the liquids in storages 18 and 20).

TABLE 5

| | Slurry oil | Hydrocarbon products |
|---|---|---|
| Asphaltene | 16% | 3% |
| Saturates | 12% | 37% |
| Aromatics | 63% | 55% |
| Resins | 9% | 5% |
| Viscosity (Pa · s@40° C.) | 1.6935 | 0.0254 |

The disclosed process is a cost-effective process and can be applied to treat deteriorated heavy fractions of petroleum oil, such as vacuum bottoms and slurry oil. The disclosed process requires no hydrogen gas and makes use of glycerol, which is a by-product of the production of biodiesel. The quality of treated heavy oil is significantly improved using the present process. For example, the contents of containments (sulfur), asphaltene, and resins are significantly reduced. Fractions of saturates and light aromatics (one/two-ring aromatics) are increased. Thus, the viscosity of the treated products becomes lighter and less viscous. The process disclosed herein may be used as a precursor step prior to the processes of coking and hydrocracking so that more light products can be produced.

The foregoing description of the preferred embodiments of the present disclosure have been presented to illustrate the principles of the present disclosure and not to limit the invention to the particular embodiment illustrated. It is intended that the scope of the disclosure be defined by all of the embodiments encompassed within the following claims and their equivalents.

Therefore what is claimed is:

1. A hydrogen-free process for upgrading heavy hydrocarbon liquids, comprising:

a) mixing a pre-heated heavy hydrocarbon liquid feedstock with glycerol and a catalyst to form a mixture, wherein the mixture has a heavy hydrocarbon liquid feedstock to glycerol weight ratio from about 5000:1 to about 100:10 and a heavy hydrocarbon liquid feedstock to catalyst weight ratio from about 5000:1 to about 100:10;

b) feeding the mixture into a first reactor comprising propellers, heated up to a temperature in a range from about 200° C. to about 450° C. to partially treat the mixture, maintaining a pressure in the first reactor in a range from about 0.6 MPa to about 0 MPa absolute, and driving said propellers to apply shear forces to the mixture in a range from about 300 $N/m^2$ to about 10000 $N/m^2$;

c) after a preselected period of time, flowing the partially treated mixture to a second reactor having a holding volume larger than the first reactor, heated up to a temperature in a range from about 250° C. to about 380° C. and maintaining a pressure in the second reactor in a range from about 0.6 MPa to about 0 MPa absolute to further treat the partially treated mixture, said second reactor having a bottom with a bottom exit port and top exit port such that first hydrocarbon fractions are separated from second hydrocarbon fractions, wherein the first hydrocarbon fractions have a boiling point higher the second hydrocarbon fractions, and the second hydrocarbon fractions are vaporized and flow up through the top exit and collected into a distillation column, and said first hydrocarbon fractions sink to the bottom of the second reactor and are flowed out through the bottom exit port and recirculated back to the first reactor; and d) collecting an upper portion of the second hydrocarbon fractions separated from a lower portion of the second hydrocarbon fractions in the distillation column out through an upper exit port and storing the collected upper portion of the second hydrocarbon fractions, and collecting the lower portion of the second hydrocarbon fractions out through a lower exit port and storing the collected lower portion of the second hydrocarbon fractions, wherein the upper portion of the second hydrocarbon fractions has a boiling point lower than the lower portion of the second hydrocarbon fractions, wherein the process is carried out with no external hydrogen gas.

2. The hydrogen-free process according to claim 1, wherein the mixing of the pre-heated heavy hydrocarbon liquid feedstock with glycerol is done in a heavy hydrocarbon liquid feedstock to glycerol weight ratio from about 1000:1 to about 100:2.

3. The hydrogen-free process according to claim 1, wherein the mixing of the pre-heated heavy hydrocarbon liquid feedstock with glycerol is done in a heavy hydrocarbon liquid feedstock to glycerol weight ratio from about 1000:1 to about 100:5.

4. The hydrogen-free process according to claim 1, wherein said catalyst is any one or combination of metal oxides containing metals from Groups 4, 6, 8, 12 and 13 of the Periodic Table, alkaline earth metal oxides, transition metals supported on a catalyst support, and transition metal doped catalysts.

5. The hydrogen-free process according to claim 4, wherein said metal oxides containing metals from Groups 4, 6, 8, 12 and 13 of the Periodic Table include any one or combination of $TiO_2$, $ZrO_2$, $Al_2O_3$, ZnO, $Cr_2O_3$, $WO_3$, $Fe_2O_3$, $Fe_3O_4$ and $MoO_3$.

6. The hydrogen-free process according to claim 4, wherein said alkaline earth metal oxides include any one or combination of CaO, MgO, and BaO.

7. The hydrogen-free process according to claim 4, wherein said transition metal doped catalysts include the alkaline earths doped with any one or combination of transition metals belonging to Groups VIIB, VIII, IB of the Periodic Table.

8. The hydrogen-free process according to claim 7, wherein the transition metals belonging to Groups VIIB, VIII, IB of the Periodic Table comprise any one or combination of Mn, Re, Fe, Co, Ni, Ru, Pd, Pt, Cu and Pb.

9. The hydrogen-free process according to claim 4, wherein the catalyst support comprises any one or combination of $SiO_2$, aluminum silicates, clays, zeolites and hydroxylapatite.

10. The hydrogen-free process according to claim 1, wherein the temperature of the first reactor is maintained at a temperature in a range from about 280° C. to about 380° C.

11. The hydrogen-free process according to claim 1, wherein the pressure in the first reactor is maintained in a range from about 0.2 MPa to about 0 Mpa absolute.

12. The hydrogen-free process according to claim 1, wherein the pressure in the second reactor is maintained in a range from about 0.2 MPa to about 0 Mpa absolute.

13. The hydrogen-free process according to claim 1, including driving first reactor propellers to apply shear forces to the mixture in a range from about 2000 $N/m^2$ to about 10000 $N/m^2$.

14. The hydrogen-free process according to claim 4, wherein the transition metal doped catalysts are transition metal doped alkaline earth metal oxides.

* * * * *